United States Patent [19]

Hess

[11] Patent Number: 4,729,598

[45] Date of Patent: Mar. 8, 1988

[54] PATIENT CHAIR SYSTEM

[76] Inventor: Jack H. Hess, 15455 Ella Blvd., #75, Houston, Tex. 77090

[21] Appl. No.: 28,657

[22] Filed: Mar. 20, 1987

[51] Int. Cl.[4] ..... A47C 7/72

[52] U.S. Cl. ..... 297/180; 297/453; 297/439; 5/453

[58] Field of Search ..... 297/180, 453, DIG. 10; 5/453, 455, 469

[56] References Cited

U.S. PATENT DOCUMENTS

| | | | |
|---|---|---|---|
| 2,461,432 | 2/1949 | Mitchell | 5/469 |
| 2,782,834 | 2/1957 | Vigo | 297/180 |
| 3,757,366 | 9/1973 | Sacher | 297/453 |
| 3,778,851 | 2/1973 | Howorth | 297/453 |
| 3,822,425 | 7/1974 | Scales | 5/469 |
| 4,136,413 | 1/1979 | Scales | 297/180 X |
| 4,279,044 | 7/1981 | Douglas | 5/453 |
| 4,453,766 | 6/1984 | DiVito | 297/DIG. 10 |
| 4,472,847 | 9/1984 | Gammons et al. | 5/453 |
| 4,587,678 | 5/1986 | Love et al. | 297/DIG. 10 |
| 4,631,767 | 12/1986 | Carr et al. | 5/453 |

FOREIGN PATENT DOCUMENTS

| | | | |
|---|---|---|---|
| 2558700 | 8/1985 | France | 297/180 |

*Primary Examiner*—Francis K. Zugel

[57] ABSTRACT

A convalescent chair for hospital and nursing home patients and the like including a chair structure forming a back rest, arm rests and shoulder and head support for patients. A seat support structure is pivotally connected to the forward portion of the chair structure and is elevated by a motorized jack from a substantially horizontal position to an inclined position to assist in raising a patient from the seated position to the standing position. A plurality of air sacs and a therapy pad are supported by the seat support structure and are supplied filtered and cooled air to provide sufficient air flow for inflation of the air sacs and for effective discharge of air from the upper portion of the air sacs. An air distribution conduit extending from a blower to an air supply manifold in assembly with the seat support structure forms a heat exchanger portion so that air being drawn through an internal chamber of the chair by an exhaust fan imparts cooling to air flowing through the air distribution conduit.

18 Claims, 8 Drawing Figures

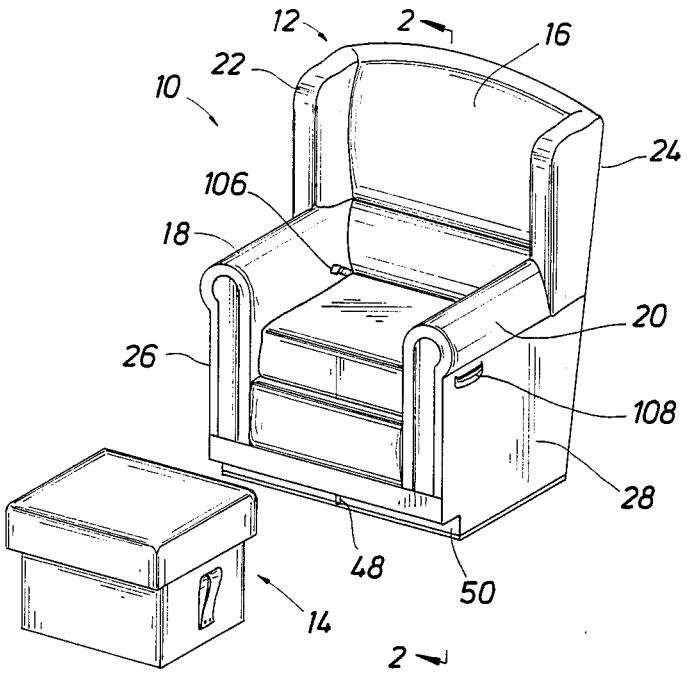
FIG. 1
FIG. 2
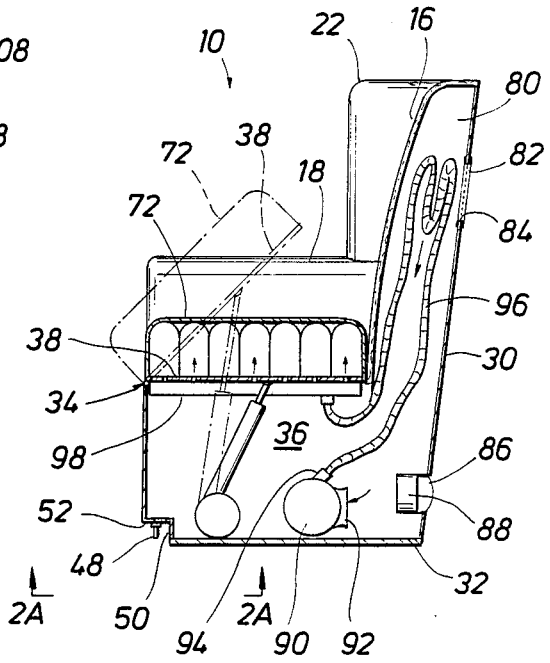
FIG. 3
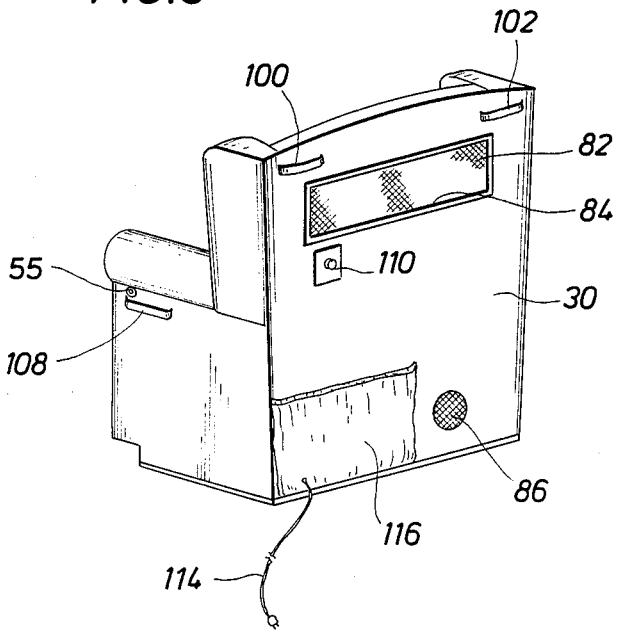
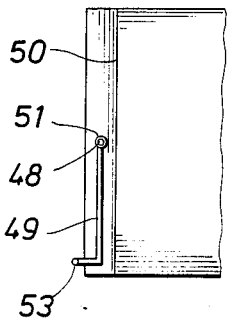
FIG. 2A

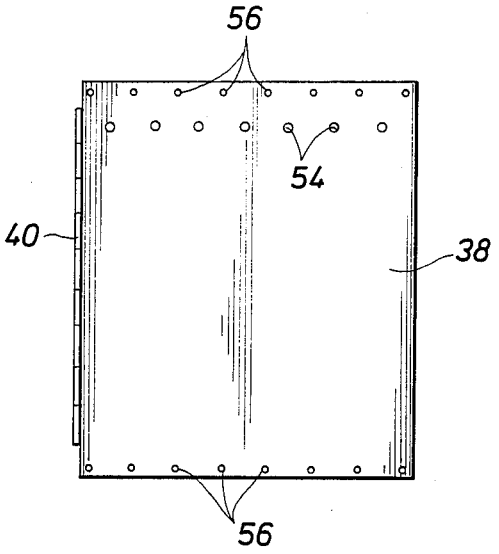
FIG. 4
FIG. 5
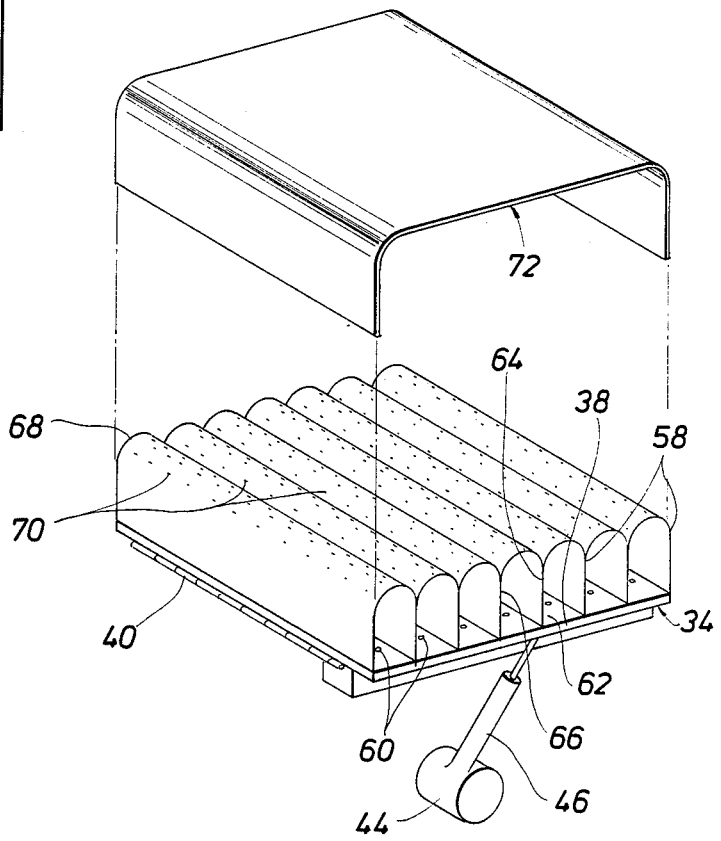
FIG. 7
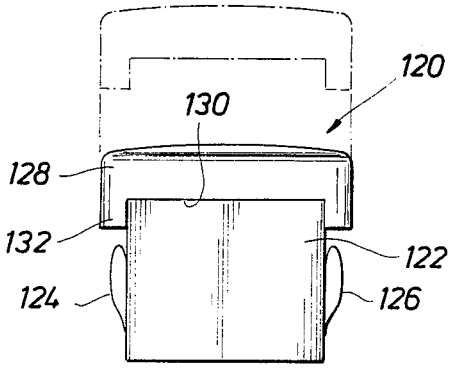
FIG. 6
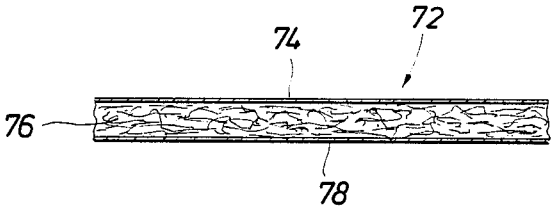

PATIENT CHAIR SYSTEM

FIELD OF THE INVENTION

This invention is directed generally for chairs for use in and about various patient care facilities such as hospitals, nursing homes and also for use in the domestic environment such as by convalescing persons, elderly persons and the like. More specifically, the present invention is directed to a patient chair system forming a seat or bottom portion having a plurality of air sacs for efficient patient weight distribution to minimize the development of pressure induced lesions and to provide for efficient temperature control and moisture removal for patient comfort to enhance the convalescing progress of the patient toward a more healthy condition.

BACKGROUND OF THE INVENTION

It is well known that a convalescing patient will spend a great majority of time in bed. Many different types of hospital beds have been developed to enhance the care and comfort of the patient during convalescent activities. For example, the bed structures disclosed in U.S. Pat. Nos. 3,822,425, 3,909,858, 4,488,322 and 4,638,159 are specifically designed to protect patients from the development of pressure induced lesions or bed sores during protracted patient convalesce. At times however, it is quite beneficial for patients to assume a comfortable sitting position and to move about. For this reason, many hospitals, nursing homes and other convalescent centers are provided with chairs for use by patients. In most cases, the chairs are simply large, stuffed chairs which provide for patient comfort. In many cases these chairs are covered with a water resistant material such as any one of a number of commercially available polymer materials which will not remove moisture from the patient and which will not provide for cooling of the patient. In fact, a great majority of the materials utilized for chair covers will retain heat and moisture rather than permit removal or dissipation of heat and moisture from the skin tissue of the patient. In virtually all cases hospital chairs are provided with seats which only provide for patient support and comfort and do not protect the patient against the development of pressure induced lesions.

Convalescing patients must frequently sit in chairs for extremely long periods of time without changing positions. Since in the sitting position majority of the patient's weight is applied to the seat portion of the chair the mechanical pressure between the patient's skin and the seat portion of the chair is frequently great enough for the development of pressure lesions. The skin and sub skin tissues of the patient contain a multitude of capillaries for circulating blood to the skin. If the mechanical pressure of the skin against the surface of a bed, chair is sufficiently great that the capillaries are collapsed or restricted, there is insufficient blood supply to portions of the skin tissue. This condition of poor blood supply causes the skin and sub skin tissue to deteriorate, thus developing pressure induced lesion or bed sores. The blood supply at the skin of the patient also provides for effective transmission of moisture from the patient in the form of perspiration. It is desirable therefore that the chair system provide effectively for removal of moisture from the patient and to also provide for cooling of the patient. Obviously under circumstances where ineffective cooling takes place certain areas of the patient's skin tissue is subjected to excessive heat which is a contributing factor to the development of pressure induced lesions. Further, moisture continuously present at the skin of the patient also enhances the development of pressure induced lesions and prevents efficient healing of the skin tissue after pressure lesions have developed. In the case of patients sitting in chairs, the skin tissue about the buttocks and thighs of the patient is frequently subjected to excessive mechanical pressure conditions which enhance the development of pressure lesions. It is desirable therefore to provide for efficient, even distribution of the weight of a patient over a substantial area of the seat portion of the chair to thus minimize the mechanical pressure induced to any portion of the patient's skin surface. It is also desirable to provide for efficient moisture removal and cooling from the bottom or seat portion of the chair to thus provide efficiently for patient comfort and to enhance therapeutic activity when the patient is in a seated position.

In many cases hospital chairs are merely plain stuffed, comfortable chairs. When elderly or physically unsound patients are sitting in these chairs the patient can slump to one side and become uncomfortable without possibility of being shifted to a comfortable position unless nursing personnel provides such assistance. It is desirable therefore to provide a chair system incorporating means for efficient support of the patient to prevent undesirable slumping. In many cases patients are connected to other therapeutic apparatus during the times they are seated in hospital chairs. For example intervenous fluid equipment may be utilized or the patient my be intubated such as with a trachea tube, food supply tubes, etc. It is desirable therefore to provide a chair system which will effectively prevent the patient from inadvertently dislodging other hospital apparatus while seated in a convalescent chair.

SUMMARY OF THE INVENTION

It is therfore a primary feature of the present invention to provide a noval convalescent chair which effectively minimizes mechanical pressure to the skin of the patient while the patient is seated.

It is another feature of the present invention to provide a novel convalescent chair which provides for effective moisture removal and heating or cooling of the patient as in appropriate for enhancing comfort and therapeutic activity.

It is another feature of this invention to provide a novel convalescent chair which may be utilized for long periods of time by patients without any significant risk of developing pressure induced lesions.

It is another important feature of this invention to provide a novel convalescent chair having restraining apparatus to permit effective control of the position of the patient even though the position may not have the capability of personal support in a seated position.

It is another feature of this invention to provide a novel convalescent chair which may be effectively activated by nursing personnel to enhance lifting of a patient from the seated position to the standing position without requiring nursing personnel to lift the entire weight of the patient.

Another important feature of this invention includes the provision of a novel convalescent chair having a plurality of air sacs for patient support and wherein the air sacs and air supply system therefor are designed to provide efficient patient support regardless of the weight or physic of the patient.

It is another feature of this invention to provide for efficient support of the feet of a patient depending upon needs selected by nursing personnel, which is provided in the form of a multi-position ottoman that may be positioned for efficient support of the feet and legs of the patient.

Briefly, the present invention is accomplished through the provision of a patient convalescent chair which includes a chair frame having a back rest, arm rests and lateral shoulder supports for the patient. The convalescent chair mechanism also includes a bottom or seat support having a plurality of air sacs each having an inlet receiving pressurized and filtered air from an air supply system. The air sacs are provided with multiple pin holes in spaced relation about the upper surface thereof such that air continuously escapes from the air sacs through the pin holes and is directed upwardly toward the patient. The air sacs are covered with a removable therapy pad having an internal layer of soft fiberous material such as Dacron TM which is sandwiched between upper and lower panels of sheet material. The upper panel of sheet material is impervious to water, solids and air and is pervious to water vapor. This upper panel may be in the form of a Nylon® Taffeta panel having a monolithic coating. The lower layer of material may be formed by a suitable fabric such as uncoated Nylon® fabric which permits air circulation therethrough from the pin holes of the air sacs to thereby provide a condition of turbo charged osmosis to remove moisture from the patient which is attracted through the upper panel by osmosis or capillary attraction.

The seat portion of the chair is pivoted at the front portion of the chair and is activated mechanically by a motorized screwjack or by any other suitable lifting mechanism to enhance lifting of the patient from the seated position to a standing position. An appropriate foot activated switch is located at the lower portion of the chair and is operable by the foot of nursing personnel to control lifting movement of the seat while steadying or partially supporting the patient during lifting of the patient to the standing position. The patient may also be steadied by a nurse during seating activity while the pivotal seat lowers the patient to the seated position.

Air being circulated through the air sacs is filtered at an air inlet to prevent the inside of the chair and air sacs from being contaminated by dust and other particulates. Thus filtered air is provided by a blower to inflate the air sacs and provide a sufficient volume of air to compensate for air discharged from the pin holes of the air sacs. To compensate for the increased heat of air compression by the air blower a long air distribution conduit supplying the air sacs forms a heat exchanger portion. External air is then drawn through a filter and across the heat exchanger portion by an exhaust fan. The flowing air of the air distribution conduit is cooled so that the patient is supplied with air at an appropriate temperature for comfort.

To enhance the comfort of the patient in the seated position a nove ottoman device is provided which is basically in the form of a support pedestal having a removable cap portion. The pedestal may be employed without the cap to establish an intermediate leg position of the patient. The cap may be positioned on the support pedestal for a more elevated position of the legs of the patient. The cap portion may be removed and used independently to support the feet or legs of the patient in a lowered position.

For auxiliary support of the patient while sitting in the chair, strapped loops are provided on the back and adjacent the arm rest portions of the chair. To support the upper body portion of the patient a pair of support straps may be connected to the back portion of the chair and may be crossed over the chest of the patient to thus provide efficient support to prevent the patient from slumping forwardly or sidewardly in the chair. Strap loops adjacent the arm rest portions of the chair enable straps to be utilized to secure the lap or upper leg portions of the patient and perhaps the arms of the patient to prevent inadvertent removal of tubes from a patient undergoing therapeutic activity.

BRIEF DESCRIPTION OF THE DRAWINGS

In order that the manner in which the above recited features, advantages and objects of the present invention are attained and can be understood in detail, more particular description of the invention, briefly summarized above, may be had by reference to the specific embodiments thereof which are illustrated in the appended drawings, which drawings form a part of this specification.

It is to be understood, however, that the appended drawings illustrate only a typical embodiment of this invention and therefore are not to be considered limiting of its scope, for the invention may admit to other equally effective embodiments. In the Drawings FIG. 1 is an isometric illustration of a patient convalescent chair and ottoman constructed in accordance with the present invention.

FIG. 2 is a sectional view of the convalescent chair of FIG. 1 showing the normal position of the chair seat in full line and the pivotally elevated position of the chair seat in broken lines.

FIG. 3 is an isometric illustration of the convalescent chair of FIG. 1 shown from the rear and side portions thereof.

FIG. 4 is a plan view of the seat support platform of the convalescent chair of FIGS. 1–3 with the air sacs removed therefrom.

FIG. 5 is an isometric illustration of the seat platform with the air sacs attached thereto.

FIG. 6 is a fragmentary sectional view of the therapeutic pad system of the convalescent chair hereof.

FIG. 7 is a sectional view of the ottoman of FIG. 1 illustrating the cap structure thereof in assembly with the support pedestal.

DETAILED DESCRIPTION OF PREFERRED EMBODIMENT

Referring now to the drawings and first to FIG. 1 a patient convalescent chair system constructed in accordance with the present invention is illustrated generally at 10 and incorporates a basic chair assembly shown generally at 12 and an ottoman assembly illustrated generally at 14. The chair assembly 12 incorporates a back rest portion 16, arm rests 18 and 20 and transverse shoulder and head support portions 22 and 24. The chair construction also defines side walls 26 and 28 and a rear wall 30 which, in addition to providing basic chair structure, also cooperate with a bottom wall 32 and a seat support panel 34 to form an enclosure or compartment 36 within which various power energized components of the chair system are located.

The seat support structure 34 which is shown in FIGS. 1, 4 and 5 comprises a generally rectangular support plate 38 which may be composed of any one of a number of suitable strong and lightweight material. For example, the support plate 38 may be composed of ¾" plywood having a layer of fiberglas which forms the upper surface of the support plate. As shown in the plan view of FIG. 4 the support plate 38 is secured by an elongated hinge 40 to the front portion of the chair structure and is therefore pivotal forwardly to raise the seat portion of the convalescent chair and thus accomplish elevating movement of the patient in the chair toward the standing position. During patient raising activity of this nature, nursing personnel can stabilize the patient and provide a patient guiding function with very little lifting being necessitated. A motor 44 which may be electrically energized or energized in any other suitable fashion operates a jack mechanism 46 to raise and lower the support plate 38. The jack mechanism 46 may conveniently take the form of a screw jack or any other suitable linear actuator capable of providing sufficient mechanical energy to raise and lower the support plate 38 with a patient seated thereon. The motor 44 is energized by means of a power and control circuit including a switch actuator rod 48 which is engaged by the foot of nursing personnel to accomplish controlled raising or lowering of the support panel 38 without necessitating the use of the hands to do so. The switch rod 48 is connected to a suitable switch assembly for controlling activation of the motor 44 in the desired manner for extension or contraction of the jack mechanism 46. The switch rod 48 is located within an angular recess in the lower front portion of the chair assembly, which recess is defined by chair surfaces 50 and 52. The angular recess permits a nurse to stand close to the patient so that nurse will be in a better position for applying lifting or stabilizing force to the patient as necessary. The switch 48 depends downwardly from the surface 52 and thus is located at an out of the way position to prevent it from being activated by the patient or inadvertently activated by cleaning personnel. The switch 48 is located centrally of the front portion of the chair thereby enabling nursing personnel to stand in front of the patient and activate the swtich 48 with a foot in the appropriate direction for raising or lowering the support panel 38. Thus, the arms of the nursing personnel are free to stabilize and guide the patient as the patient is lifted by the chair apparatus to a standing position. Conversely, with the seat structure of the chair elevated in the manner shown in broken lines in FIG. 2, a patient is enabled to lean against the seat portion and be gradually lowered to the seated position by nursing personnel while being steadied by a nurse controlling the switch 48 by foot engagement therewith.

As shown in the plan view the support plate 38 is provided with a plurality of spaced air inlet opening fittings 54 which are each located between pairs of snap elements 56 which are affixed to opposed edge portions of the support panel. A plurality of air sacs 58 are provided which are disposed in side-by-side relation on the upper surface portion of the support panel 38. The air sacs are composed of a flexible material which is impervious to air and water. For example, the air sacs may be composed of heat sealed Nylon ®. Each of the air sacs 58 includes an air inlet fitting 60 which is receivable within respective ones of the air inlet opening fittings 54. Each of the air sacs incorporate mating snap elements which are receivable by snap elements 56 of the support panel 38. Thus, the air sacs are secured to the support plate by the respective snap elements 56 and air communication is established with the interior of the air sacs by means of the air inlet openings formed by interrelated fittings 54 and 60. The air sacs cooperatively form a support for the buttocks and thigh portions of the patient and function to establish a large surface area of contact with the patient in order that mechanical force to any specific portions of the patient's skin is minimized so that capillary blood supply can function effectively to maintain skin tissue healthy. Each of the air sacs defines a bottom wall 62 and a pair of opposed sidewalls 64 and 66. The air sacs also form a curved elongated upper wall 68 having multiple pin holes 70 formed therein. The pin holes 70 provide for discharge of air along the upper surface portions of the air sacs. This air discharge is utilized for efficient cooling of the patient and for removal of moisture such as is developed by perspiration.

A therapy pad illustrated generally at 72 is connected to each corner of the support panel 38 or to the front portion of the chair assembly adjacent the support panel by means of snaps or other suitable connector devices. The therapy pad is utilized by folding it over the air sacs 58 such that it overlies the upper perforated surface portions 68 of the air sacs with the free end thereof being secured between one of the air sacs and the back rest portion of the chair. As shown in the partial sectional view of FIG. 6 the therapy pad 72 includes an upper layer or panel of material 74 which is pervious to water vapor and impervious to air. The layer or panel 74 is composed of a fabric material such as Nylon ® Taffeta for example which is provided with a monolithic coating of a composition rendering it pervious to water vapor and impervious to air. As a patient perspires the moisture is conducted away from the patient by osmosis or capillary attraction and passes through the monolithic coating and into the panel 74. Immediately below the panel 74 is provided a suitable thickness of fiberous material 76 such as Dacron TM fibers which form a pad of suitable thickness. The loose Dacron TM forming the pad permit air to circulate through the fiberous pad and to attract any moisture accumulation from the panel 74. The lower panel 78 of the therapy pad 72 is in the form of a suitable fabric material which permits passage of air from the pin holes of the air sacs upwardly into the fiberous pad formed by the fibers 76. For example, the lower panel 78 may conveniently take the form of an uncoated Nylon ® fabric material.

As shown particularly in FIG. 2 the back rest portion of the chair assembly shown at 16 forms an internal compartment 80 which is in communication with compartment 36. The back portion of the chair construction is provided with a filter 82 which is received within a filter opening 84. At the lower portion of the back panel 30 of the chair is provided an exhaust fan 86 which is energized by an electric motor 88 or by any other suitable fan drive system. The exhaust fan 86 exhausts air from the chamber 36 and the chamber 80 and thus draws air through the filter 82. Air drawn into the chambers 80 and 36 is therefore substantially free of dust and other contaminants which are excluded by the filter.

Within the compartment 36 is provided an air blower 90 which is also energized by an electric motor and includes an air intake 92 in communication with the chamber 36. The air blower 90 includes an exhaust 94 to which is coupled a cooling and air delivery holes 96. As the air of the chamber 36 is compressed by the blower 90 its temperature is increased by virtue of compression. For cooling of the air exiting from the discharge 94 of the blower the hose 96 has considerable length with a portion of it extending upwardly into the chamber 80 defined by the back rest portion of the chair. This upwardly extending portion of the hose 96 is disposed in serpentine configuration and provides considerable surface area which is contacted by cool air being drawn through the filter 82 and into the chamber 80 by the suction of the exhaust fan 86. Thus, the hose 96 functions as a heat exchanger to remove the heat of compression from the air exiting the discharge of the blower. The hose 96 is formed of thin, convoluted material which permits it to have significantly large surface area for good heat exchange quality. The hose 96 is coupled with an air distribution manifold 98 which is secured to the lower portion of the support panel 38. The air distribution manifold is provided with a number of spaced openings which are in communication with respective ones of the openings 54 of the support panel.

As shown in FIG. 3 the rear panel of the chair is provided with a plurality of strap connector elements 100, 102, 104 and 106. Each of the side portions of the chair is provided with at least one strap connector element such as shown at 108. To prevent a patient from slumping in the chair such as when the patient might fall asleep or when the patient becomes otherwise unable to sit upright, it is appropriate to provide for patient support. Accordingly, chest straps may be appropriately secured such as between strap connectors 100 and 106 and between strap connectors 102 and 104, thus providing support straps that cross across the chest of the patient. These straps will effectively support the patient and provide for patient safety and security even under circumstances where the patient might have fallen asleep. In the event the patient is intubated or connected to interveneous treatment apparatus the patient support apparatus will stabilize the patient and prevent the tubes or catheters from being inadvertently withdrawn from the patient. The strap connectors 108 on the side portions of the chair enable the patient also to be secured by means of a strap that extends across the lap of the patient or which forms a seat belt to prevent the patient from sliding as the seat is tilted. Also, arm restraint straps may also be secured to the strap connectors 108 in the event such is deemed appropriate by nursing personnel.

Also on the back panel 30 of the chair is provided an electrical control switch 110 which may be activated by nursing personnel to energize the exhaust fan and air blower systems of the chair. An electrical cord 112 extends from the back portion of the chair and is provided with a suitable electrical connector 114 to enable operation of the chair by means of conventional 115 volt electrical power. At the lower rear portion of the chair is provided a flexible pocket 116 into which the electric cord 112 may be placed when the chair is not in service. The pouch or pocket 116 is also of sufficient dimension to contain any other suitable equipment which is utilized in conjunction with the patient chair system.

For support of the feet and legs of the patient in proper position for efficient therapy and comfort, the patient chair system is provided with a two piece ottoman shown generally at 120. The ottoman includes a support pedestal 122 which is shown to be of generally rectangular form but which may take any other suitable configuration within the spirit and scope of the present invention. A pair of lift loops 124 and 126 are secured to opposed side portions of the support pedestal 122 to provide for lifting of the ottoman when its movement is desired. The ottoman is also provided with a removable cap structure 128 having a recess 130 which receives the upper portion of the support panel. Thus, side portions 132 of the cap structure 128 extend downwardly over the top portion of the support pedestal and maintain the cap 128 in proper assembled relation with the support pedestal. In the condition shown in FIG. 7 the feet or lower legs of the patient will be supported in their most elevated position by the two piece ottoman assembly. If the legs of the patient are intended to be lowered slightly, the cap element 128 is removed and the legs and feet of the patient are then supported by the upper portion of the support pedestal. If the patient's legs and feet should be even further lower but yet supported, the support pedestal is set aside and the cap member 128 is used to provide support for the feet and legs of the patient. This feature enables the positions of the patient's feet to be changed from time to time simply by adjusting the character of the ottoman as is desired to enhance patient comfort or therapy.

In order to utilize the patient chair system of this invention, nursing personnel will simply connect the power cord 112 to an appropriate electrical outlet and move the switch 110 to the on or operate position. The exhaust fan 86 and the air blower 90 will become immediately energized thereby introducing pressurized air from the blower through the hose 96 and into the air distribution manifold 98 where it enters and inflates the various air sacs 58. If the patient is able to move from the standing position to the seated position, the support platform 38 and its air sac assembly is allowed to remain in the position shown in full lines in FIG. 2. In the event the patient needs assistance to move from the standing position to the sitting position the nurse will engage the switch control rod 48 with the nurses foot and move it to the appropriate position for raising the seat portion of the chair toward the broken line position shown in FIG. 2. The patient can then lean against the elevated inflated air sacs covered by the therapy pad 72. Thereafter the nurse will reverse the position of the switch rod 48 thus causing the jack motor to reverse for lowering the inflated seat assembly with the patient to the full line position shown in FIG. 2. Nursing personnel will not be required to support any significant weight of the patient during this seating activity. During operation of the mechanism the heat induced to the air by compression activity of the blower 90 will be effectively removed by the heat exchange capability of the elongated, serpentine hose 96 with filtered air flowing across it from the filter 82. Thus, filtered and cooled air will be forced by the blower through the hose 96 and into the air distribution chamber 98 for injection into the various air sacs 58. The air will be discharged from the air sacs through the pin hole perforations in the upper curved portions thereof and will flow into the therapy pad to provide the lower portion of the patient with effective cooling and moisture removal. The air sacs will evenly distribute the weight of the patient over a significantly large area to maintain mechanical compression of the skin tissues of the patient at a minimum level efficient for maintaining efficient blood flow through the capillaries of the skin tissue. Thus, there will be no tendency for the development of pressure induced lesions.

The patient may be strapped to the chair system by straps extending across the chest of the patient, by arm or lap straps in the manner discussed above. Thus, infirm patients may be effectively secured within the chair system and there will be no tendency for patients to inadvertently pull away tubes and catheters etc.

When it is desired to remove the patient from the chair, nursing personnel will stand in front of the chair and steady the patient such as by grasping the shoulders. The foot switch rod 48 will then be activated appropriately to raise the seat portion of the chair to the broken line position shown in FIG. 2. Thus, the patient will be raised from a seated position to a substantially standing position without any necessity for the nurse to provide significant lifting or force. After the patient has been removed from the chair the foot switch may again be manipulated to lower the seat portion of the chair to the full line position shown in FIG. 2. Thereafter, the electrical system of the chair may be deengergized simply by shifting the switch 110 to its off position.

The therapy pad which has protected the upper portion of the air sacs from direct contact with the patient may be removed from the chair for cleaning. This feature effectively prevents any significant cross contamination of patients from any moisture that might have accumulated within the therapy pad.

In view of the foregoing it is seen that the present invention is one well adapted to attain all of the objects and features hereinabove set forth together with other features which are inherent in a description of the apparatus itself. It will be understood that certain combinations and subcombinations are of utility and may be employed without reference to other features and subcombinations. The scope of this invention is intended to be limited only by the scope of the intended claims and is not limited by the specific embodiment shown and described herein.

I claim:

1. A convalescent chair for hospital and nursing home patients and the like, comprising:

(a) a chair structure forming a back rest, arm rests and shoulder and head supports for patients, said chair further forming seat support means and forming an enclosure therein and an air inlet opening for said enclosure communicating said enclosure with environmental air;

(b) a plurality of air sacs being secured in side by side relation to said seat support means and having multiple air vent holes formed in the upper surfaces thereof;

(c) means communicating pressurized air into said air sacs to inflate the same and to provide a sufficient flow of air into said air sacs to compensate for discharge of air from said multiple holes;

(d) means for exhausting air from said enclosure and stimulating air flow through said air inlet opening of said enclosure;

(e) electrically energized air blower means located within said enclosure and forming air intake and discharge openings; and (f) an elongated heat exchanger conduit interconnecting said discharge opening of said electrically energized air blower means with said plurality of air sacs for supply of pressurized air to said air sacs, said elongated heat exchanger conduit being so located within said enclosure that air being drawn through said air inlet opening of said enclosure by said air exhausting means and said electrically energized air blower means is passed over said elongated heat exchanger conduit for cooling air being being discharged from said air blower.

2. A convalescent chair as recited in claim 1 wherein:

(a) said seat support means is pivotally connected to the front portion of said chair structure; and (b) seat elevation means is incorporated within said chair structure and is interconnected with said seat support means, said seat elevation mechanism being controllably energized for pivoting said seat support means from a substantially horizontal position to an inclined position.

3. A convalescent chair as recited in claim 2 wherein said seat elevating means comprises an electrically energized screw jack.

4. A convalescent chair as recited in claim 1 wherein said seat support means comprises:

(a) a generally rectangular seat support panel having a plurality of air inlet openings formed therein;

(b) said air sacs having air inlet openings, fittings mating with said air inlet openings of said seat support panel;

(c) an air distribution manifold being in communication with each of said air inlet openings; and (d) said elongated heat exchanger conduit conducting pressurized air from said electrically energized air blower means to said air distribution manifold.

5. A convalescent chair recited in claim 1 wherein:

(a) a portion of said elongated heat exchanger conduit forms a serpentine heat exchanger configuration; and (b) said electrically energized air blower means and said air exhausting means induce flow of environmental cooling air across said elongated heat exchanger conduit for removing heat therefrom for cooling of air flowing therethrough.

6. A convalescent chair as recited in claim 5 wherein said means for inducing air flow comprises:

(a) a filter being disposed within said air inlet opening into said enclosure to filter air drawn therein; and (b) an air exhausting means comprising an exhaust fan being disposed within said enclosure and exhausting air therefrom, said exhaust fan developing a suction condition within said enclosure thus drawing air through said filter and across said elongated heat exchanger conduit.

7. A convalescent chair as recited in claim 1 including a plurality of strap connectors being secured to back and side portions of said chair structure and adapted to receive straps for supporting a patient seated within said convalescent chair.

8. A convalescent chair as recited in claim 1 wherein:

(a) said chair structure defines an internal enclosure defined beneath said seat support means and within said back rest;

(b) said electrically energized air blower means has an intake thereof located within said enclosure and a discharge coupled with said elongated heat exchanger conduit;

(c) said elongated heat exchanger conduit having a portion of serpentine configuration located within said enclosure of said back rest.

9. A convalescent chair as recited in claim 8 wherein said air distribution hose is of convoluted configuration establishing a large air contact area to enhance the air cooling capability thereof.

10. A convalescent chair as recited in claim 1, including:

(a) a support pedestal adapted to be positioned in front of said chair structure; and (b) a cap member being received by the upper portion of said support pedestal and providing a support surface for supporting the feet and legs of a patient seated in said chair structure.

11. A convalescent chair as recited in claim 10 wherein said cap member forms a recess receiving the upper portion of said support pedestal, said cap member being restrained against transverse movement relative to said support pedestal.

12. A convalescent chair for hospital and nursing home patients and the like, comprising:

(a) a chair structure forming a back rest, arm rests and shoulder supports for patients and forming an enclosure therein and an air inlet opening for said enclosure communicating said enclosure with environmental air;

(b) a seat support structure being pivotally connected to the front portion of said chair structure;

(c) a motorized jack mechanism being located within said chair structure and being operative to impart pivotal movement to said seat support from a substantially horizontal position to an inclined position;

(d) a plurality of air sacs being mounted in side-by-side relation on said seat support, said air sacs each forming curved perforate upper surfaces for air distribution beneath a patient;

(e) means for exhausting air from said enclosure and stimulating air flow through said air inlet opening of said enclosure;

(f) electrically energized air blower means located within said enclosure and forming air intake and discharge openings; and (g) an elongated heat exchanger conduit interconnecting said discharge opening of said electrically energized air blower means with said plurality of air sacs for supply of pressurized air to said air sacs, said elongated heat exchanger conduit being so located within said enclosure that air being drawn through said air inlet opening of said enclosure by said air exhausting means and said electrically energized air blower means is passed over said elongated heat exchanger conduit for cooling air being discharged from said air blower.

13. A convalescent chair as recited in claim 12 wherein:

said elongated heat exchanger conduit forms a serpentine portion being disposed for contact by air being drawn through said air inlet opening by said air exhausting means.

14. A convalescent chair as recited in claim 13, including:

(a) an air distribution manifold being secured to the lower portion of said seat support means; and (b) said elongated heat exchanger conduit being in communication with said air distribution manifold.

15. A convalescent chair as recited in claim 14, wherein seat support means comprises:

(a) a generally rectangular seat support panel forming a plurality of spaced air inlet openings therein, said air distribution manifold being in communication with said plurality of air inlet openings; and (b) each of said air sacs forming an air inlet opening fitting which is receivable within respective ones of said air inlet openings.

16. A convalescent chair as recited in claim 15, including a therapy pad being releasably secured to the front portion of said chair structure and forming a cover for said upper surface portions of said air sacs.

17. A convalescent chair as recited in claim 16 wherein said therapy pad comprises:

(a) an upper layer of fabric material;

(b) an intermediate pad of fiberous material capable of permitting air circulation therethrough; and (c) a lower layer of fabric material permitting substantially free circulation of air from said perforate upper portions of said air sac therethrough and into said fiberous layer for efficient removal of moisture.

18. A convalescent chair as recited in claim 17, including:

(a) a support pedestal to be positioned in front of said chair structure for support of the feet and legs of a patient seated therein; and (b) a removable cap element being received by the upper portion of said support pedestal and providing an upper surface for contact by the feet and legs of said patient.

* * * * *